United States Patent [19]

Buccicone

[11] 3,942,784

[45] Mar. 9, 1976

[54] DUAL SHEET PILING MACHINE

[75] Inventor: Velio S. Buccicone, Portage, Ind.

[73] Assignee: Bucciconi Engineering Co., Inc., Gary, Ind.

[22] Filed: Nov. 13, 1974

[21] Appl. No.: 523,418

[52] U.S. Cl. ..... 271/64; 271/69; 271/188; 271/193; 193/35 R; 193/35 TE; 214/6 DS; 214/6D

[51] Int. Cl.[2] ..... B65H 29/30; B65H 29/70; B65H 31/24

[58] Field of Search ..... 271/64, 69, 173, 188, 193, 271/209, 215, 217, 223; 214/6 DS, 6 FS, 6 D; 193/35 R, 35 C, 35 TE

[56] References Cited

UNITED STATES PATENTS

| | | | |
|---|---|---|---|
| 2,008,200 | 7/1935 | Clauss | 271/193 |
| 2,340,797 | 2/1944 | Cummings et al. | 271/193 |
| 2,636,736 | 4/1953 | Snyder | 271/188 |
| 2,957,691 | 10/1960 | Williams | 271/215 |
| 3,053,532 | 9/1962 | Weidman | 271/173 |
| 3,063,713 | 11/1962 | Perrine | 271/193 |
| 3,606,313 | 9/1971 | Buccicone | 271/193 |

*Primary Examiner*—Evon C. Blunk
*Assistant Examiner*—Robert Saifer
*Attorney, Agent, or Firm*—Guy A. Greenawalt

[57] ABSTRACT

A sheet piling machine for stacking metal sheets of material which respond to magnetic force which machine is characterized by an upright supporting frame defining two in-line stacking areas having suitable lift platforms on which sheets are piled, an elongate overhead magnetic sheet conveyor mounted on the supporting frame above the first stacking or piling area, a roller skate conveyor forming an approach to the entrance end of each of the stacking areas and spaced below the overhead conveyor in predetermined, vertical relation so as not to interfere with the entry of sheets to the respective stacking areas, each roller skate conveyor being inclined in the direction of the associated stacking area so as to cause sheets deposited thereon to be advanced by gravity into the associated stacking area, end stop and back stop mechanisms and a side guide mechanism for each of the stacking areas, and electrical control circuits for controlling the operation of the magnetic conveyor and associated mechanisms so as to advance selected sheets onto the proper roller skate conveyor for deposit in a designated stacking area and to remove the stacks when completed.

18 Claims, 12 Drawing Figures

106
113
114
115
117'
117

MASTER
250
IS
253
RESET
COUNTER
252
254
READ OUT
259
ALTERNATE PILING
255
S1
#2 PILE
#1 PILE
MAG SELECTOR
S2
251
M1
257
258
260
262
263
264
265
266
267
268
172
272
C1
C2
C3
C4
C5
C6
C7
C8
C9
C10
1 2 3 4 5 6 7 8 9 10
110 VOLT
256
170
270

230 V. D.C.
275
277
M1
251'
276
278
A
280
282
283
284
285
286
287
288
290
292
293
294
295
296
297
298
300
302
303
304
257a
257b
258a
258b
260a
260b
262a
262b
263a
263b
264a
264b
265a
265b
266a
266b

DUAL SHEET PILING MACHINE

This invention relates to sheet handling apparatus and methods of operating the same and is more particularly concerned with improvements in methods and apparatus for piling or stacking sheets of a material which responds to magnetic force so as to enable the sheets to be deposited selectively in dual stacking areas.

In the handling of metal sheet materials in a fabricating or processing line it is frequently desirable to be able to provide for piling in dual stacks with arrangements for controlling the flow of the individual sheets into a selected stack in order to separate the sheets according to size, shape or some other difference in the character of the sheets or to enable a stack of sheets in one of the stacking areas or piler boxes to be removed from the machine while another stack is being formed in another stacking area and thus avoid interruption of the flow of sheets into the piling machine. A general object of the invention is to provide a piling machine for handling sheets of material wherein the machine is capable of piling or stacking selected sheets in a plurality of separate piling or stacking areas and provision is made for controlling the operation of the machine so that its operation is wholly or partially automatic.

A more specific object of the invention is to provide a sheet piling machine wherein an overhead sheet carrying conveyor is arranged above a plurality of in-line piling areas and its operation is controlled to enable successive individual sheets fed to the machine to be advanced to and deposited in a selected piling area with the selection being automatic according to a predetermined setting or at the will of an operator.

A further object of the invention is to provide a sheet piling machine which is characterized by an elongate sheet carrying conveyor supported for advancing sheets held on the bottom thereof in a path extending above dual in-line stacking areas with each stacking area having a sheet supporting and advancing conveyor at the entrance thereof for receiving sheets deposited thereon and for delivery of the sheets to the associated stacking area, and a control system for operating the overhead conveyor and associated mechanisms so as to advance the sheets for deposit on a selected sheet supporting and advancing conveyor and into the associated stacking area according to the presence or absence of a predetermined characteristic of the sheet, with the operation being automatic or under control of the operator.

Another object of the invention is to provide apparatus for piling metal sheets which are responsive to magnetic force wherein dual in-line piling areas are arranged beneath an elongate overhead magnetic conveyor, with inclined roller skate conveyors at the entrance to the piling areas, and with control circuitry for activating and deactivating the magnetic conveyor so as to deliver successive sheets to selected roller skate conveyors for deposit in the associated piling areas according to a predetermined characteristic of the sheets or predetermined control settings.

Still another object of the invention is to provide a sheet piling machine wherein an electromagnetic conveyor is arranged above dual in-line stacking areas or piler boxes with each of the latter having associated end stop, back stop and side guide mechanisms together with a pallet supporting and conveying apparatus which is power driven for moving a pallet into stack receiving position, raising and lowering it for the stacking and removing the completed stack, and wherein a roller skate conveyor is arranged at the entrance end of each piler box for gravity delivery of sheets deposited thereon into the piler box and an electrical control system is provided for the driven members which enables presetting for automatic operation with delivery of sheets to a preselected piler box or alternately into separate piler boxes.

These and other objects of the invention will be apparent from a consideration of the sheet piling machine which is shown by way of illustration in the accompanying drawings wherein.

Figure 1:
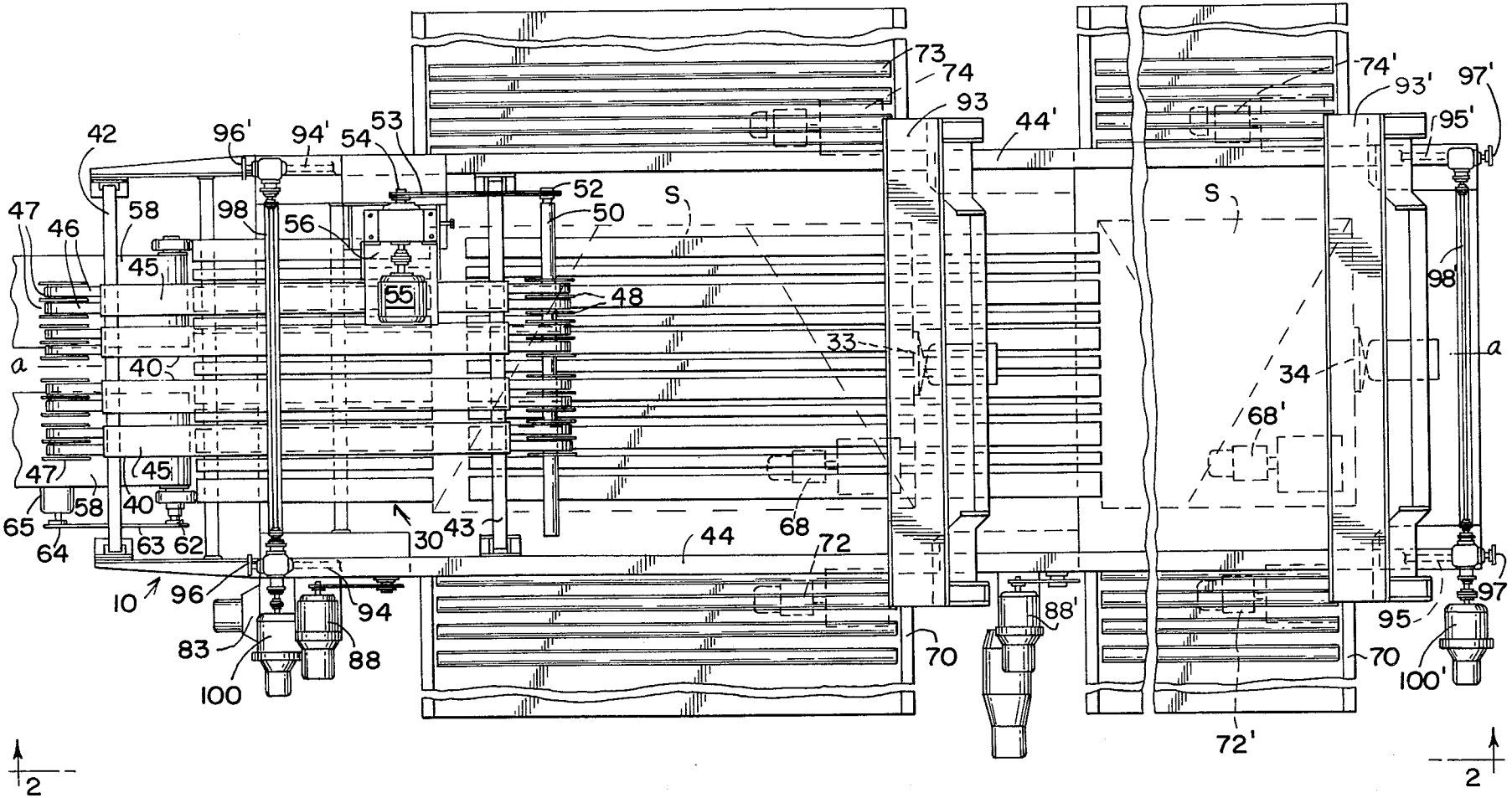
FIG. 1 is a plan view of a piling machine which incorporates therein the principal features of the invention, with portions of the machine being omitted and other portions being broken away.
Figure 2:
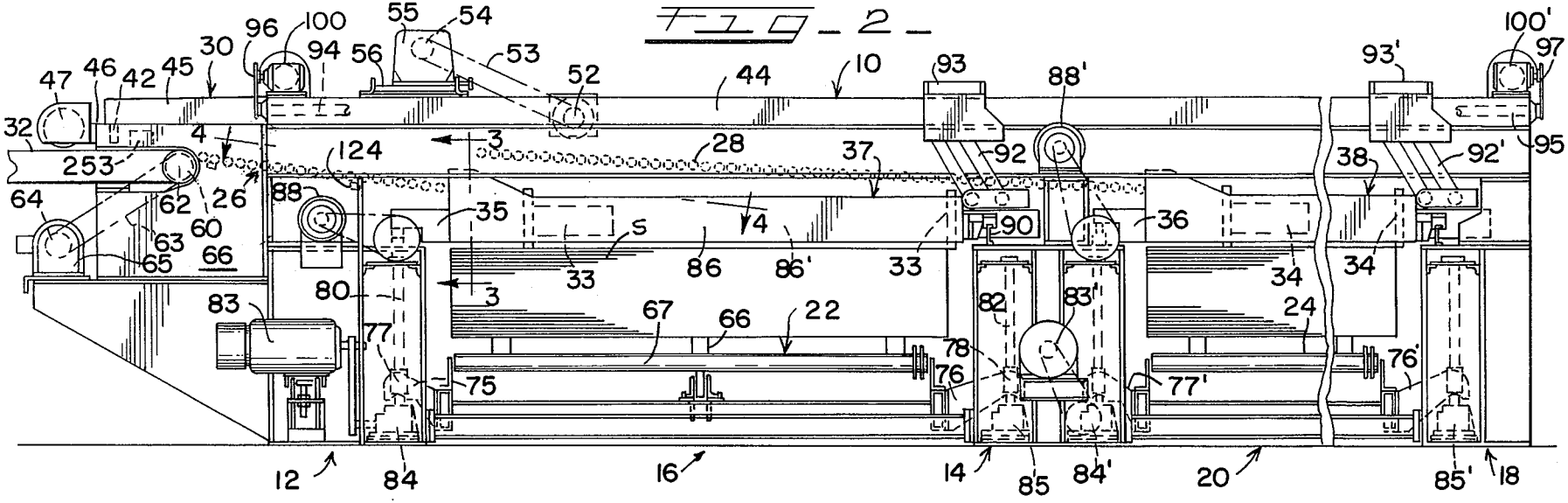
FIG. 2 is a side elevational view of the machine shown in FIG. 1, with portions omitted and other portions broken away.

Referring first to FIGS. 1 and 2, there is illustrated a sheet piling machine which is adapted for carrying out the sheet piling operations required in practicing the sheet piling method or system embodying the invention. The illustrated machine comprises an elongate, upright frame structure 10 with an upright cross frame structure constituting a front or entrance end stand 12, an upright middle stand 14 which is spaced longitudinally from the entrance end stand 12 so as to define a first piling or stacking area 16 between the two stands 12 and 14, and an upright end stand 18 at the far end which is spaced longitudinally from the middle stand 14 so as to define a second piling or stacking area 20 between the two stands 16 and 18 which are in line longitudinally. The two stacking areas 16 and 20 may be designated No. 1 and No. 2 piling or stacking areas, respectively. Each of the piling or stacking areas 16 and 20 has a pile supporting or stack supporting lift structure, indicated at 22 and 24, with associated operating and stack height control apparatus and with mechanism for removing the stack when completed, or when desired. Sheet supporting and advancing skate roller conveyors 26 and 28 are mounted in inclined relation at the entrance to the two in-line piling or stacking areas 16 and 20 so as to enable sheets received thereon to advance by gravity into the associated piling or stacking areas. An overhead electromagnetic sheet conveyor assembly 30 is mounted above the supporting frame structure 10, at the entrance end of the machine, which conveyor 30 is adapted to be operated to advance sheets fed to its bottom face, by an entry conveyor 32, for deposit on the skate roller conveyor 28. Each of the pile or stack receiving areas 16 and 20 is provided with a longitudinally adjustable end stop mechanism 33, 34 and a back stop mechanism 35, 36, the latter being at fixed positions on the vertical cross frames or stands 12 and 14 and the former being supported for longitudinal adjustment on longitudinal top members of the support frame 10. Each of the stack receiving areas 16, 20 is also provided with an adjustable side guide mechanism indicated at 37 and 38.

The overhead conveyor 30, at the entrance end of the machine, in the form shown, comprises a plurality of elongate rail units 40 (FIG. 1) which are spaced laterally, preferably equi-distant on opposite sides of the longitudinal center line of the machine, indicated at a—a, and supported adjacent their opposite ends on longitudinally spaced cross beams 42 and 43, the latter being supported by and extending between laterally spaced, longitudinal side frame members 44, 44' which extend the length of the support frame 10. The rail units 40 are of identical construction with each unit comprising an elongate frame structure 45 housing longitudinally spaced electromagnets (not shown) which are arranged, so that when actuated, they hold metal sheets by magnetic force against the bottom run of a pair of traveling V-belts 46 which V-belts 46 are carried on idler pulleys 47 at the trailing ends and driven pulleys 48 at the leading ends. The pulleys 48 are mounted on a common drive shaft 50 at the leading end of the assembly 30 which is extended at one end and carries a sprocket 52 connected by a drive chain 53 with an output sprocket 54 of a drive motor and clutch assembly 55 mounted on a suitable support structure 56 at one side of the machine. For further details of the magnetic rail units 40 resort may be had to U.S. Pat. No. 3,199,654, dated Aug. 10, 1965, or U.S. Pat. No. 3,782,529, dated Jan. 1, 1974 both of which disclose rail units suitable for use in this machine.

The sheets S enter the machine on the entry conveyor 32 which, in the form shown, comprises a pair of wide, flat belts 58 supported at the leading end on a cross roller structure 60 having a sprocket 62 at one end which is connected by chain 63 with the output sprocket 64 of a motor drive assembly 65. The leading end of the entry conveyor 32 extends a short distance beneath the trailing end of the conveyor 30 and is supported on a bracket forming frame structure 66 on the trailing side of the end frame 12. The leading or discharge end of the infeed or entry conveyor 32 terminates at the trailing end of the skate roller conveyor structure 26 which leads to or forms the approach to the first, or No. 1, piling or stacking area 16. When the conveyor 30 is inoperative sheets advanced on the entry conveyor 32 will be delivered to the skate roller conveyor 26 for advance into the piling or stacking area 16.

The two piling or stacking areas 16 and 20 (FIG. 2) are in the form of longitudinally aligned boxes with the leading and trailing sides closed and the lateral sides open so as to enable completed stacks or piles of the sheets to be removed out of the side of the machine and empty pallets to be moved into the proper boxes. The two box-like areas 16 and 20 are provided with lift assemblies 22 and 24 which, in the illustrated machine, are of identical construction. In the piling area 16 the lift assembly 22 comprises a pallet forming structure 66 on which the sheets are supported while a stack or pile of the sheets S accumulates. The pallet 66 rests on a driven roller bed 67 of a scissors-type lift assembly which may be constructed in accordance with the disclosure in U.S. Pat. No. 3,369,675, granted Feb. 20, 1968, to which resort may be had for details not described herein. The rolls in the bed 67 are driven by connection with a drive motor assembly indicated at 68, for shifting the loaded pallet 66 laterally of the machine onto the pack conveyor 70 which has its rollers driven by a suitable motor drive assembly, indicated at 72 in FIG. 1. A pallet conveyor 73 is provided, at the opposite side of the machine, for feeding empty pallets onto the lift table 67, which conveyor 73 is driven by the motor drive assembly 74. The lift assembly 22 is carried in a vertical path by means of end brackets 75, 76 (FIG. 2) thereon which rest on nut arrangements 77, 78 and which ride up and down on vertically disposed screw post members 80, 82, the screw members being housed in the cross frame structures 12 and 14. The screw members 80, 82 are driven by suitable drive connection with drive motor assembly 83 through belt or chain drive and shaft connected right angle gear boxes 84 and 85.

The side guide assembly 37 comprises elongate side guide members 86, 86' which are mounted for lateral adjustment with oppositely disposed, vertical guide faces in parallel planes and in laterally spaced relation. The side guide members 86, 86' extend longitudinally between the cross frames 12 and 14. They may be constructed as shown in U.S. Pat. No. 3,061,305, granted Oct. 30, 1962, with the trailing ends thereof mounted on a transversely extending screw shaft (not shown) having right and left hand threads and driven by a drive connection with a drive motor 88 supported on the cross frame structure 12. The leading or opposite ends of the side guide members 86, 86' are mounted for travel on a cross beam 90 on the cross frame 14 and have a rack and pinion arrangement (not shown) for insuring adjustment in parallel planes as described in U.S. Pat. No. 3,061,305.

The end stop mechanisms 33 and 34 may be of identical construction, such as shown in U.S. Pat. No. 3,256,011, granted June 14, 1966, or U.S. Pat. No. 3,799,540, granted Mar. 26, 1974, to which resort may be had for details not herein disclosed. The end stop mechanisms 33 and 34 are suspended by parallel linkages 92, 92' from cross frames 93, 93' of identical construction, which cross frames are mounted for adjustment longitudinally of the piler areas or boxes 16 and 20 with which they are associated. The cross frames 93 and 93' are mounted for longitudinal travel on the longitudinally extending top side frame members 44 and 44'. The cross frames 93 and 93' each have a driving connection with a pair of parallel screws 94, 94' and 95, 95' housed in the side frame members 44, 44'. The screws 94, 94' and 95, 95' are connected through suitable drive train members 96, 96' and 97, 97' with cross shafts 98 and 98' which are driven by motors 100, 100' so that the position of each of the end stop mechanisms 33, 34 relative to its associated piling areas 16 and 20 may be readily adjusted independently. The motor drive for adjusting the position of the end stop mechanisms 33 and 34 may, of course, be omitted and a suitable arrangement for manual adjustment substituted. The end stop face pad of each of the mechanisms 33, 34 is preferably mounted on a vertical pivot so as to be angularly adjustable as in U.S. Pat. No.

3,111,311, granted Nov. 19, 1963 and thereby adapt the machine for handling sheets of odd shape, such as, the sheets shown in U.S. Pat. No. 3,111,311.

The back stop mechanisms 35 and 36 are of identical construction and only one will be described in detail. The mechanism 35 (FIGS. 4 to 9) comprises a face plate 102 on a supporting frame 103 which is hingedly mounted by means of vertical pivot 104 in the open side of a carriage formation or frame 105 of generally U shape and having a slide bar 106 (FIGS. 6, 7 and 9) extending horizontally from a vertically disposed base or web member. The pivot 104 is mounted between top and bottom leg forming plate assemblies 107 and 108 of the carriage frame 105. The slide bar 106 is supported at the forward end on a roller 110 (FIG. 8) mounted in suitable bearing brackets 112. At its opposite or rearward end the slide bar 106 is pivoted at 113 (FIGS. 6 and 9) to the top of a slidably mounted bracket 114 which has a screw threaded connection with an adjusting screw 115. The adjusting screw 115 is mounted in longitudinally spaced bearing brackets 116 on the top of the center cross frame structure 14 and is provided with a hand wheel 115' on the free end thereof for manually turning the screw so as to adjust the carriage 105 longitudinally of the machine. The carriage forming bracket 114 (FIGS. 6 and 9) is mounted for sliding movement on the horizontal frame member 117 which has a guide slot 117' for receiving a co-operating portion of member 114. The face plate 102 has mounted on its rearward side a worm gear 118 (FIGS. 6 and 7) which is engaged by a worm shaft 120 journaled in the framing of the carriage formation 105. The end of the worm shaft 120 is formed with a cross pin 122 so as to accept a bifurcated end of a turning tool (not shown) for enabling manual turning so as to swing the face plate 102 into the proper position according to the configuration of the leading edge of the plates being handled. The back stop assembly 35 has a portion of the skate roller conveyor 26, at the forward end, attached to the carriage 105, as hereinafter described, so as to extend, with extension of the back stop plate or pad 102, in adjusting the working position of the latter.

Figure 3:
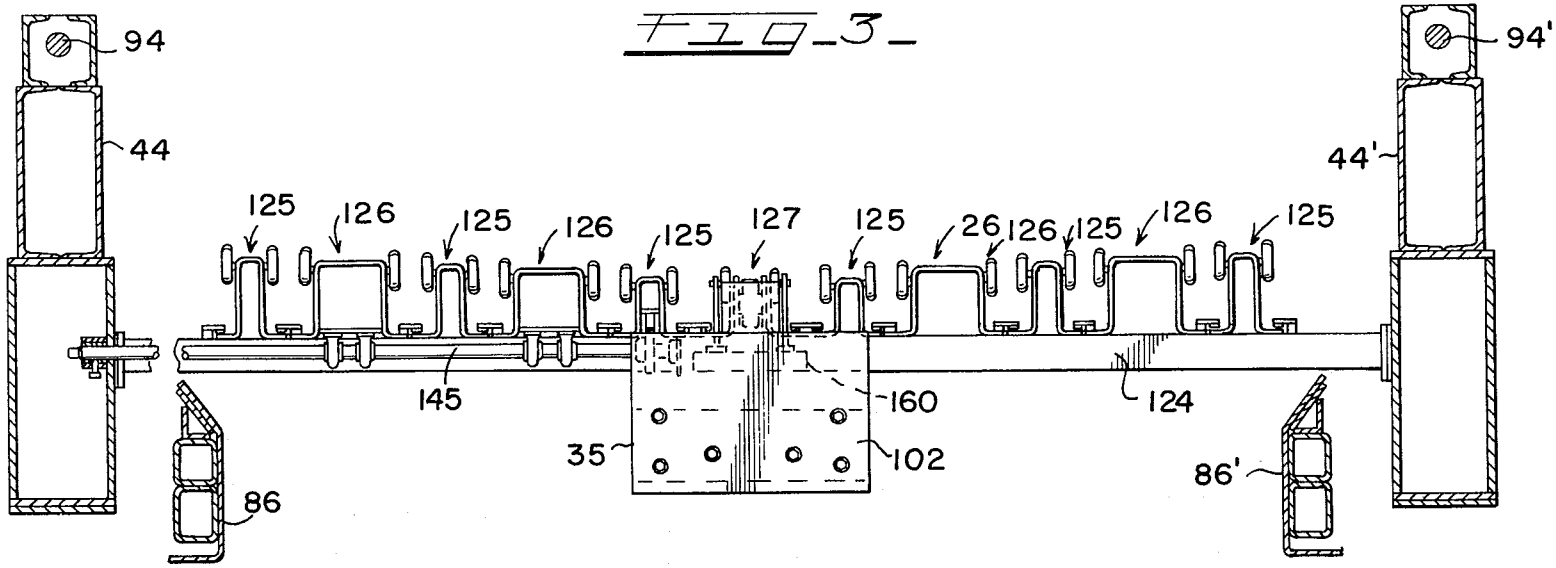
FIG. 3 is a partial cross sectional view taken on the line 3—3 of FIG. 2, with portions broken away.

The skate roller conveyor assembly 26 (FIGS. 2 to 6) comprises a plurality of longitudinally spaced cross bar frame members 124 forming a base on the top face of which a plurality of skate roller assemblies, indicated at 125, 126 and 127, are mounted so as to extend in parallel, transversely spaced, longitudinal relation and in alternate arrangement except for the center assembly 127. Each of the skate roller assemblies 125, 126 and 127 has two lines or rows of skate rollers 128 which are in multiple, transversely spaced, double line or double row relation and extend longitudinally of the machine. The assemblies 125 are mounted for longitudinal sliding movement on the base members 124 and the assemblies 126, which are fixed on the base members 124, are arranged in alternate spaced relation with the assemblies 125, on each side of the center skate roller assembly 127. Each of the fixed skate roller assemblies 126 (FIG. 3) comprises a skid rail formation 130 (FIG. 8) of inverted U-shaped cross section with side edge flanges 132, 132' which are secured on the base members 124. Two lines or rows of the rollers 128 are mounted in free rolling relation on horizontal axle forming cross pins on the rail side walls 133, 133', near the top of the latter, so as to revolve freely with the periphery traveling in a path extending above the top surface or wall 134 of the skid rail.

The slidably mounted assemblies 125 (FIGS. 3 and 5) are constructed in a similar manner with a skid rail 135 of inverted U-shaped cross section and having outturned side edge flanges 136, 136' which are confined in sliding relation in laterally spaced, track forming or guideway forming members 137 mounted on the supporting cross members 124. Two rows or lines of the skate rollers 128 are mounted on horizontal axle forming pins on the top portions of the side walls 138, 138' with the peripheries traveling in a path above the top face or top wall 140 of the rail member 135. Each of the roller assemblies 125 FIG. 8 has a transverse plate 142 extending between the side walls 138, 138' on which an elongate rack 143 is mounted for engagement by a pinion 144 carried on a cross shaft 145 which extends from one of the side plate or side frame members 146 on the end stand or cross frame assembly 12. The cross shaft 145 is supported intermediate the side frame members 146, 146' by means of pairs of axially spaced bearing members 147 mounted on a bottom cross plate 148 of the fixed skate roller mounting assemblies 126. The one end of cross shaft 145 is mounted in a sleeve bearing 150 on the frame member 146 and provided with an end portion which is squared or otherwise shaped at 152 to take a wrench for manual turning of the shaft. A locking bolt or screw 153 is provided in the bearing 150 to enable the shaft to be locked in position when the assembly 125 is in the desired position of adjustment, which will depend upon the longitudinal and rotational adjustment of the stop member 102. In the arrangement illustrated there is a separate cross shaft for adjusting each of the moveable roller assemblies or units 125. In some arrangements it may be desirable to have one shaft adjust more than one of the assemblies 125 and 126. The assemblies 125 and 126 are arranged with the outermost assemblies 125 at a higher level than the center assemblies so as to enable a sheet of light material to bow of its own weight, transversely, or about a longitudinal center line.

Figure 5:
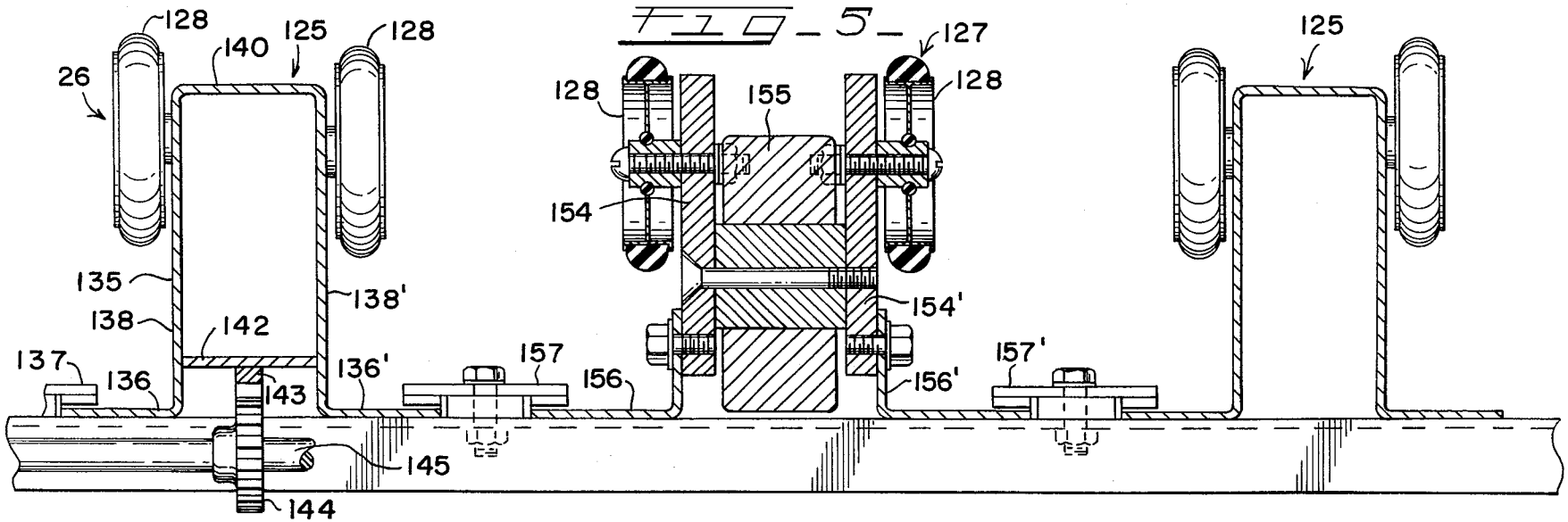
FIG. 5 is a partial cross sectional view, to an enlarged scale, taken on the line 5—5 of FIG. 4.

The center roller assembly 127 (FIGS. 3 and 4) is specially constructed and is mounted for longitudinal sliding movement on the base members 124 in the same manner as the skate roller assemblies 125. The center assembly 127 comprises a pair of laterally spaced, parallel side plate members 154, 154' which extend in vertical planes and support between them a series of longitudinally spaced electromagnet coil members 155. The plates 154, 154' are of a material which will enable the plates to serve as pole pieces for the magnet coils 155. They also support two lines or rows of skate rollers 128 mounted for free rotation on axle forming, horizontally disposed pins near the top margins of the side plates or pole plates 154, 154' so that the peripheries are in a path above the topmost edges of the pole plates 154, 154'. The side plates or pole forming members 154, 154' have flange forming angle bar members 156, 156' on their lower ends which are of stainless steel or other non-magnetic material so as to insulate the plate members 154, 154' from the supporting frame members 124. The angle bars have their outturned flange formation confined in a pair of spaced, double guideway or track forming members 157, 157' which are mounted on the base members 124 and which provide half of the track mounting for the two adjoining skate roller assemblies 125 as shown in FIG. 5. The center roller assembly 127 is provided with the electromagnets so as to enable the center of a heavy sheet to be pulled down along the center by means of magnetic force and thereby bow the sheet and stiffen it, enabling better control of the sheet as it enters the piling box or stacking area 16.

The skate roller conveyor 26 is mounted in fixed position on the end stand or cross frame 12 by the spaced cross bar support members 124 in FIG. 2, so that the top surface is slanted in the direction of the piler box for gravity flow or gravity advance of the sheets. The center roller skate assembly 127, which is slidably mounted on the base members 124, is attached at its forward end to the carriage 105 for the back stop assembly 35. A bracket formation 160 (FIG. 6) has upwardly opening sockets 162 for receiving a cross pin 163 on the side plates 154, 154' of the center assembly 127 so that upon extension of the carriage 105 the center skate roller assembly 127 will be extended with it.

The back stop assembly 36 for the piling area 20 is of the same construction as the back stop assembly 35 and the associated skate roller conveyor 28 is of the same construction as the skate roller conveyor 26 and elements thereof corresponding to elements of back stop 36 and conveyor 26 and associated mechanism, where referred to, are identified by the same numerals primed. The roller conveyor 28 is mounted in the same manner as roller conveyor 26, with sufficient incline in the direction of the associated piler box or stacking area 20 to cause sheets deposited thereon by the overhead conveyor 30 to advance by gravity into the box 20. The trailing end of the roller conveyor 28 is, of course, disposed at a level above the piler box or piling area 16, which will provide clearance for passage of sheets into the box 16 from the roller conveyor 26.

Figures 9, 11, 12:
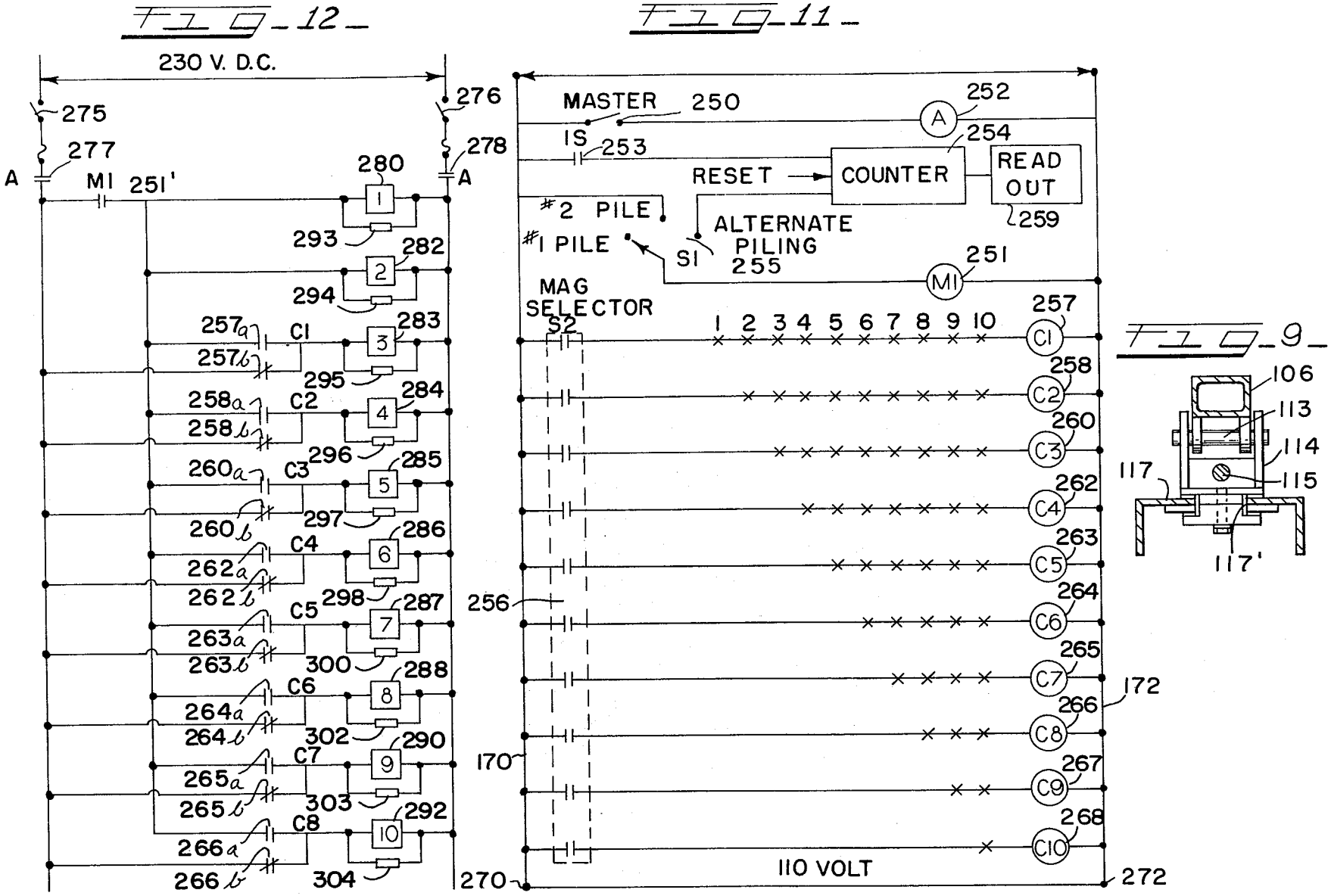
FIG. 9 is a fragmentary cross sectional view taken on the line 9—9 of FIG. 6.
FIGS. 10–12 are detailed schematic circuit diagrams showing the electrical circuits which control the various operations of the conveyor system of the present invention.
Figure 10:
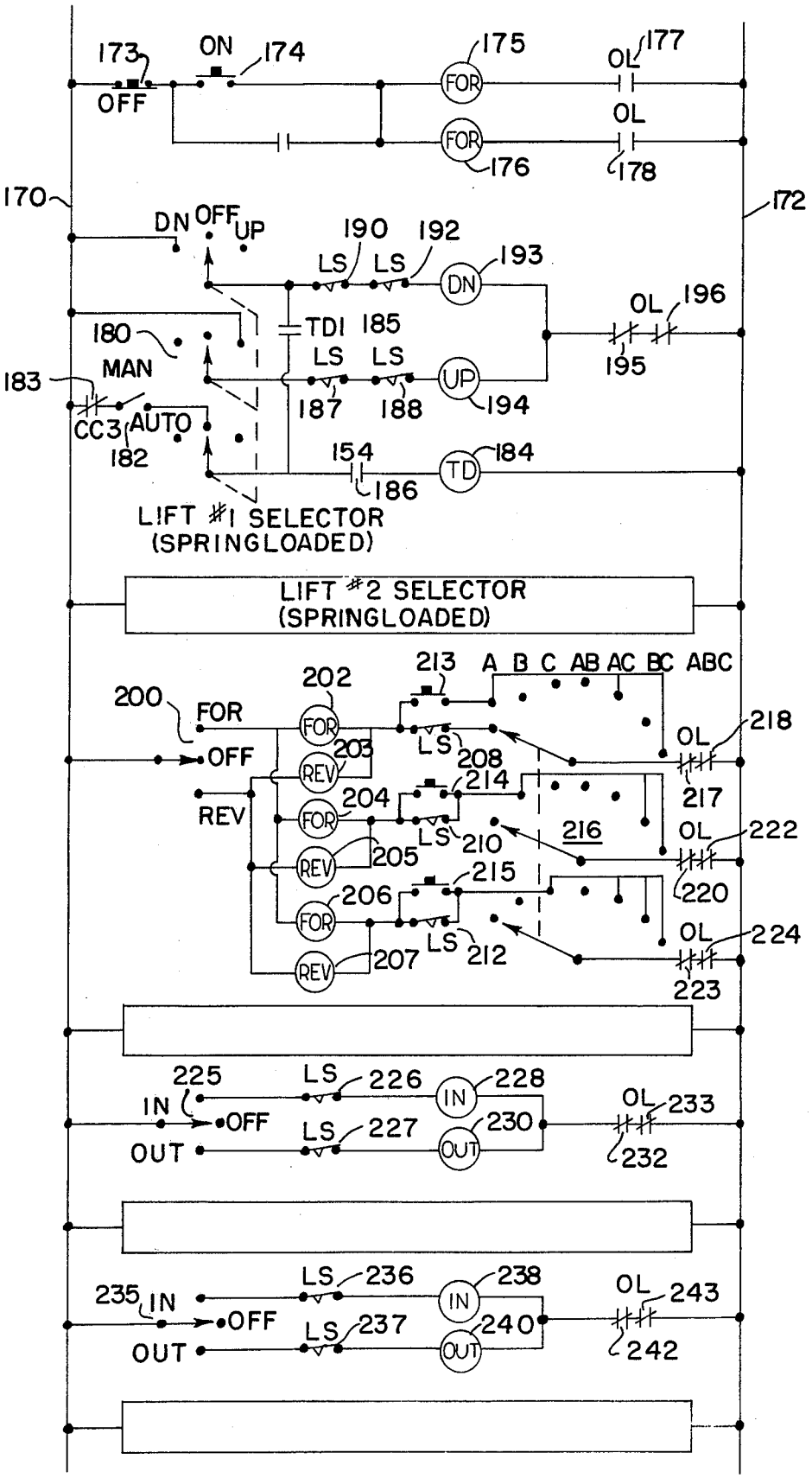

The operation of the machine is under the control of an operator with manually settable electrical control elements connected in the electrical circuits as illustrated in FIGS. 10, 11 and 12 and hereinafter described.

The circuit of FIG. 10 controls the operation of the various drive motors of the conveying system of the piling machine. Each of the separate control portions of the circuit of FIG. 10 is connected in parallel across power buses 170 and 172 which are connected to a 110 volt AC power source as shown in FIG. 11.

Specifically, the control circuit of FIG. 10 controls the operation of the entry conveyor drive motor 65, the main magnetic conveyor drive motor 55, and the lift assembly drive motors 83 and 83', the pallet conveyor drive motors 74 and 74', the lift roll drive motors 68 and 68', the pack conveyor drive motors 72 and 72', the end stop drive motors 100 and 100' and the side guide motors 88 and 88', for the first and second piling areas 16 and 20, respectively. The control portions for the drive motors of the second piling area 20 are shown in block form inasmuch as they are identical to the control portions for the drive motors of the first piling area 16 which are fully shown and described herein.

The control portion for the entry conveyor and the main magnetic conveyor comprises off and on switches 173 and 174 respectively, starter contactor coils 175 and 176 for the entry conveyor and main magnetic conveyor drive motor respectively and overload contactors 177 and 178. When switch 174 is placed in the "ON" position, the power across buses 170 and 172 will be applied to the entry conveyor and main magnetic conveyor drive motor starter contactor coils 175 and 176 to activate their respective drive motors. Overload contactors 177 and 178 protect the starter windings from excessive currents and will open should an over current situation exist. While a control circuit for single phase motors has been herein described, it, of course, can be appreciated that a similar control circuit for three phase motors could be substituted.

The lift assembly drive motor control portion comprises a three position-three section spring loaded switch 180, knife switch 182, counter contacts 183, time delay relay 184 having contacts 185, proximity switch 186, limit switches 187, 188, 190 and 192, lift assembly drive motor starter windings 193 and 194, and overload contactors 195 and 196. Starter winding 193 activates the lift assembly drive motor in the down direction and starter winding 194 activates it in the up direction.

Figure 6:
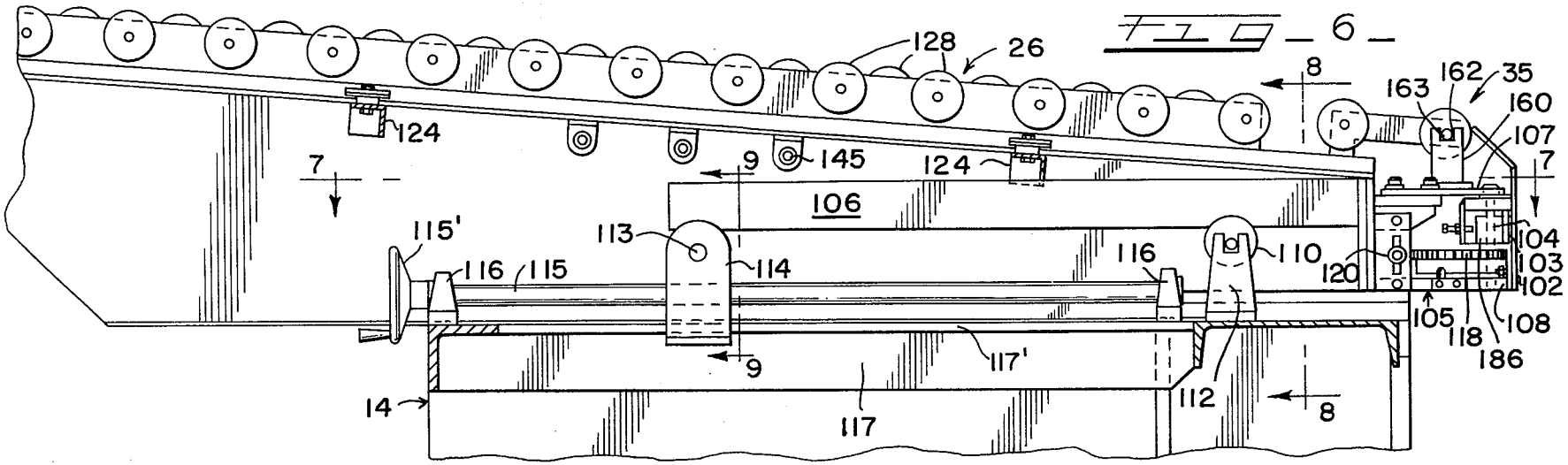
FIG. 6 is a longitudinal sectional view taken on the line 6—6 of FIG. 4.
Figures 4, 7, 8:
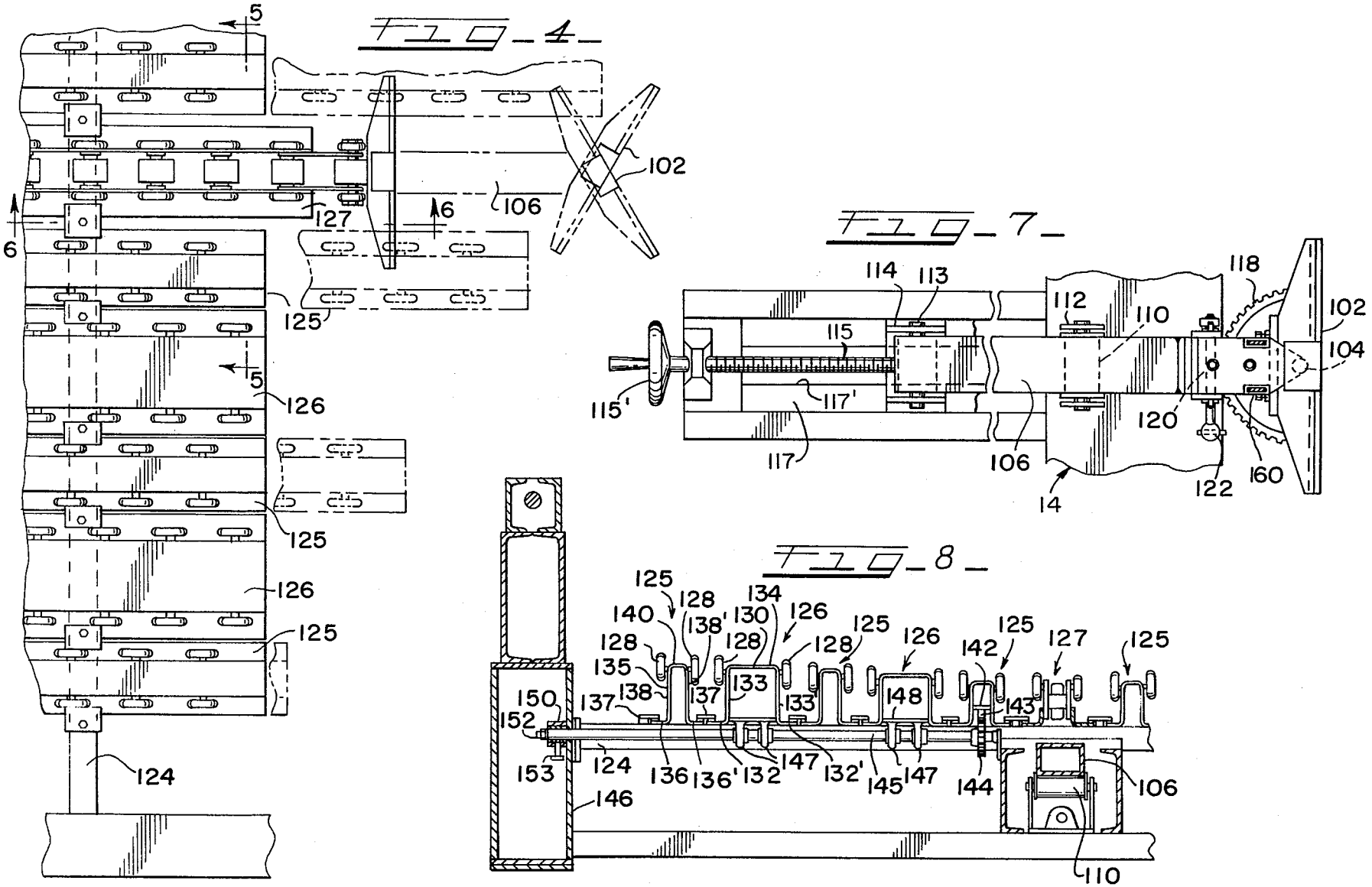
FIG. 4 is a partial plan view taken on the line 4—4 of FIG. 2, to a larger scale.
FIG. 7 is a longitudinal sectional view taken on the line 7—7 of FIG. 6.
FIG. 8 is a vertical sectional view taken on the line 8—8 of FIG. 6.

Knife switch 182 places the lift assembly in either a manual or automatic mode for lowering the pallet as it is loaded. In the automatic mode, as the pallet is loaded, the loaded sheets will obtain a level which approaches the vicinity of proximity switch 186 which may be located in the back stop mechanism as indicated in FIG. 6. When proximity switch 186 is activated, the time delay relay 184 will be set for a predetermined period, for example, three seconds. After the predetermined period has elapsed, and assuming switch 180 is in the down "DN" position, relay contacts 185 will close to apply power to the down starter winding 193. When the pallet has lowered a sufficient distance, the level of the sheet pile will be far enough from proximity switch 186 to cause it to open to thus stop the lowering of the pallet. The time delay relay 183 is provided to prevent the pallet from being lowered merely due to a steel sheet passing by the proximity switch. With switch 182 in the manual position, the pallet may be raised and lowered at will with switch 180.

Limit switches 190 and 192 limit the degree of upward travel while limit switches 187 and 188 limit the degree of downward travel. Therefore, should switch 180 be inadvertently left in either the up or down position while in the manual mode, the pallet will be automatically stopped when it reaches the limited extent of travel. Overload contactors 195 and 196 protect the starter windings from over current conditions.

The control portion for controlling the pallet conveyor drive motor, the lift roll conveyor drive motor and the pack conveyor drive motor comprises a three position switch 200, forward and reverse starter windings 202 and 203 respectively of the pallet conveyor drive motor, forward and reverse starter windings 204 and 205 respectively of the lift roll drive motor, forward and reverse starter windings 206 and 207 respectively of the pack conveyor drive motor, limit switches 208, 210 and 212 and respective override switches 213, 214 and 215, an eight position-three section drive motor selector switch 216 and overload contacters 217, 218, 220, 222, 223 and 224.

Switch 200 is utilized to activate either the forward or reverse starter winding or none of them. Limit switches 208, 210 and 212 control the maximum degree of travel of the pallet conveyor, lift roll conveyor and pack conveyor respectively and will open to deactivate their respective drive motors when the maximum degree of travel is reached.

Switch 216 provides for selecting which drive motor combination of drive motors is to be activated. With the pallet conveyor designated "A", the lift roll conveyor designated "B" and the pack conveyor designated "C", it can be seen that any combination of drive motors may be selected. For example, if switch 216 were placed in the "AB" position, the pallet conveyor and lift roll conveyor motors will be activated when switch 200 is placed in the forward or reverse position.

Overrides 213, 214 and 215 may be used to selectively override the respective limit switches. Overload contacters 217, 218, 220, 222, 223 and 224 provide over current protection for the starter windings.

The end stop and side guide driver motor control portions comprise three position switches 225, limit switches 226, 227, 236, 237, end stop drive motor starter coils 228 and 230, side guide drive motor starter coils 238 and 240 and overload contacters 232, 233, 242 and 243.

Switch 225 controls the in and out operation of the end stop mechanism. It is preferably spring loaded so that it will naturally return to the off position when not in use. Starter coil 228 activates the end stop drive motor to decrease the end stop distance and starter coil 230 causes the end stop drive motor to increase the end stop distance. Limit switches 226 and 227 control the maximum degree of end stop adjustment.

The operation of the side guide drive motor 88 is identical to the operation of the end stop mechanism except that the width of the piling area is adjusted instead of the length.

FIG. 11 is a schematic circuit diagram of the circuit which controls the mode of operation of the conveyor system of the present invention. It provides selection of a No. 1 pile mode wherein all of the sheets are piled in the first piling area 16, a No. 2 pile mode wherein all of the sheets are piled in the second piling area 20 and an alternate pile mode wherein successive sheets are alternately piled in one or the other piling areas. It also provides control of the magnetic conveyor for accommodating different size sheets while in the alternate pile mode.

The circuit of FIG. 11 comprises a master switch 250, relay coil 252, inducto switch or proximity switch 253, which may be positioned as indicated in FIG. 1, counter 254, mode selector switch 255, magnetic conveyor magnet selector switch 256, contactor coils 257, 258, 260 and 262–268, terminals 270 and 272 and magnet control contactor coil 251.

Terminals 270 and 272 are adapted for connection to a 110 volt AC external power source to be applied to buses 170 and 172. Master switch 250 is utilized to activate the DC magnet circuit of FIG. 12 which will be subsequently described.

Mode selector switch 255 selects the particular mode of operation of the conveyor system. In the position shown, the conveyor system will be in the No. 1 pile mode to stack all of the sheets in the first piling area 16.

Counter 254 is activated by proximity switch 253 and counts each sheet as it is loaded. Readout 259 provides a visual indication of the number of sheets loaded. Counter 254 is used when the system is in an automatic mode determined by switch 182 of FIG. 10. Referring to FIG. 10 for a moment, with switch 182 in the "AUTO" position and with counter 254 set to a predetermined count representing the total number of sheets to be stacked, as each sheet is stacked, proximity switch 253 will increase by count by one. When the desired number of sheets have been stacked, counter contacts 183 will open causing the system to revert back to manual operation and the system will stop.

Referring now to the magnetic conveyor control circuit of FIG. 12, it comprises power switches 275 and 276, contacts 277 and 278, magnet control contactor contact 251′, normally closed contacts **257*a*, 258*a*, 260*a* and 262*a*–166*a*, normally opened contacts 257*b*, 258*b*, 260, and 262*b*–266*b* of contactors 257, 257, 260 and 262–266 of FIG. 11, magnet coils 280, 282, 283–288, 290 and 292 and "Thyrite" resistors 293–298, 300, 302, 303 and 304.**

Contactors 257, 258, 260 and 262–266 and their respective normally closed and opened contacts control which magnet sections on the magnetic conveyor will be activated. With switch 255 in the "No. 1 pile" position, contactor 251 and its contact 251′ will cause none of the magnets to be activated so that all of the sheets will be stacked in piling area 16. With switch 255 in the "No. 2 pile" position, contactor 251 and its contact 251′ and the normally closed contacts will cause all of the magnets to be activated so that all of the sheets will be stacked into the second piling area 20.

When switch 255 is in the "alternate piling" position, contactor 251 and its contact 251′ will control those magnet sections which are selected by switch 256. Switch 256 is a shorting selector type and for example, if in the No. 4 position, the normally closed contacts **257*b*, 258*b*, 260*b* and 262*b*, and the normally opened contacts 257*a*, 258*a*, 260*a* and 262*a* will reverse so that magnets 283, 284, 285 and 286 will be under the control of contactor coil 251 and its contact 251′. All of the other magnets 287, 288, 290 and 292 will be permanently activated. Thus, with switch 256** properly set any size sheet may be handled without being prematurely dropped.

Counter 254 responsive to proximity switch 253 on alternate sheets will activate contactor 251 causing its contact 251′ to deactivate magnets 280, 282, 283, 284, 285 and 286 to drop every other sheet for stacking in piling area 20. All other sheets will be loaded into piling area 16 because contactor 251 will not be activated.

Thus, the control circuitry of the conveyor system of the present invention provides manual or automatic control for piling sheets in one or the other piling areas or both of them, and while piling into both areas, the control circuitry accommodates for the size of the sheets being loaded.

While, in the machine illustrated, the side guide members 86, 86′ are mounted equidistant from the center line a—a (FIG. 1) and are simultaneously adjustable in a transverse direction, by rotation of a common adjusting screw or shaft, they may be mounted for independent adjustment, or one may be fixed in position and the other adjustably mounted. Also the end stop mechanisms 33, 34 are shown mounted for operation on the center line a—a in the machine illustrated. It may be desirable in handling certain sheets to have the end stop mounted for operation on one side or the other of the center line. In some arrangements it may be desirable to mount the end stop mechanism on a side guide mechanism so that adjustment of the side guide will simultaneously adjust the position of the associated end stop mechanism. In the form of the machine illustrated the center skate roller assembly 127 is provided with electromagnets, the strength of which may be controlled by rheostats. Other magnet arrangements may be provided, such as, for example, permanent magnets with suitable mounting which will enable the poles to be moved relative to the top of the rollers 128 so as to control the strength. Likewise, the magnetic conveyor 30 may be equipped with suitably mounted and controlled permanent magnets so as to permit the desired operation and adjustment.

I claim:

1. A machine for handling metal sheets of material which is responsive to magnetic forces, said machine comprising an upright supporting frame structure having longitudinally spaced cross frame members constituting end frame structures at the opposite ends thereof and an intermediate cross frame structure spaced between the ends thereof, said end and cross frame structures defining longitudinally spaced, first and second areas between said structures for accommodating apparatus for forming at substantially the same level piles or stacks of the sheets which are deposited in the respective areas, a roller type conveyor arranged at the entrance forming end of each of said pile forming areas which conveyor has freely rotating rollers thereon forming a sheet supporting top face inclined downwardly and forwardly in the direction of the associated pile forming area so as to advance by gravity sheets deposited thereon and to deposit the same in the respective pile forming areas, means associated with each of said pile forming areas for guiding sheets deposited therein into a pile, an infeed conveyor having its delivery end supported on the end frame structure at the entrance end of the machine and having a sheet supporting top face aligned with the sheet supporting top face of said roller conveyor at the entrance to the associated first pile forming area, an elongate overhead magnetic conveyor having a bottom face on which sheets are held by magnetic force, which bottom face is disposed immediately above said infeed conveyor and said roller conveyors for said piling areas, said magnetic conveyor having its trailing end disposed above the leading end of said infeed conveyor and the trailing end of said roller conveyor for said first piling area and said magnetic conveyor extending to the leading end of said roller conveyor for said second piling area, and means for controlling the application of the magnetic force of said overhead conveyor and for adjusting the same according to the length of the sheet conveyed so as to enable sheets of varying length to be advanced on said infeed conveyor and delivered selectively to the roller conveyor for the first piling area or to the roller conveyor for said second piling area.

2. A machine for handling metal sheets of material responsive to magnetic forces, said machine comprising an elongate upright frame structure arranged to provide longitudinally aligned and spaced first and second sheet receiving areas each adapted to accommodate at substantially the same level a plurality of sheets in stacked relation, a first longitudinally extending conveyor means having a sheet supporting top surface arranged to advance sheets received thereon in a longitudinal, forwardly inclined path for deposit in said first sheet receiving area, a second longitudinally extending conveyor means having a sheet supporting top surface arranged to advance sheets received thereon in a longitudinal, forwardly inclined path for deposit in said second sheet receiving area, an infeed conveyor means having a sheet supporting top surface aligned with the top surface of said first, longitudinally extending conveyor means at the entrance thereto and positioned to deliver sheets to said first longitudinally extending conveyor means, means for driving said infeed conveyor to advance sheets thereon, an elongate overhead sheet carrying magnetic conveyor having a bottom face on which sheets are held by magnetic forces, said bottom face being arranged above the discharge end of said infeed conveyor and extending to a point above said second longitudinally extending conveyor, means for driving said overhead magnetic conveyor to advance sheets carried thereon in said longitudinal path and means for controlling the magnetic forces of said overhead magnetic conveyor along the length thereof according to the length of the sheet conveyed so as to enable sheets of varying length to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area.

3. A machine as set forth in claim 2 wherein said longitudinally extending conveyors comprise support members of rail-like form having mounted thereon for free rotation a plurality of longitudinally spaced skate rollers which provide a support for traveling movement of a sheet deposited thereon, and means for adjusting said support members longitudinally of the machine.

4. A machine as set forth in claim 2 wherein said longitudinally extending conveyors comprise a plurality of longitudinally extending, transversely spaced support members of rail-like form with a plurality of skate rollers mounted for free rotation thereon which are adapted to provide a traveling sheet support.

5. A machine as set forth in claim 2 wherein said longitudinally extending conveyors each comprise one or more rail-like members having a freely movable surface for receiving sheets thereon and said conveyors being mounted with said sheet receiving top surfaces inclined in the direction of the associated pile receiving areas at an angle sufficient to advance sheets received thereon by gravity into said pile receiving areas.

6. A machine as set forth in claim 2 wherein said longitudinally extending conveyor means comprise elongate roller supporting members arranged in longitudinally extending, side-by-side relation, rollers mounted on said supporting members so as to form a sheet supporting bed with the rollers on the outermost supporting members at a higher elevation than the rollers on the supporting members which are arranged inwardly thereof so as to impart a transverse curvature to the sheet supporting bed and means spaced inwardly of said outermost rollers urging a sheet supported thereon to bow downwardly along the middle thereof thereby to stiffen the same for better control of longitudinal movement.

7. A machine as set forth in claim 2 wherein each of said sheet receiving areas has an associated back stop assembly, an end stop assembly and a side guide assembly for confining sheets delivered thereto and for guiding said sheets into a vertical pile formation.

8. A machine as set forth in claim 2 wherein said magnetic conveyor comprises a plurality of longitudinally spaced magnets for supplying said magnetic forces and wherein said means for controlling said magnetic forces comprises circuit means for energizing all of said magnets so as to enable sheets to be advanced to only said second longitudinally extending conveyor for deposit in said second sheet receiving area or for deenergizing all of said magnets so as to enable sheets to be delivered only to said first longitudinally extending conveyor for deposit in said first sheet receiving area.

9. A machine as set forth in claim 2 wherein said magnetic conveyor comprises a first plurality of spaced apart manually deenergized magnets and wherein said control means comprises a proximity detector located at said infeed conveyor for detecting each sheet carried on said infeed conveyor, a counter coupled to said proximity detector for providing a control signal upon the detection of every other sheet and magnet control means coupled to said counter for controlling the energizing of said first plurality of magnets responsive to said control signal to enable alternate sheets to be advanced to said second longitudinally extending conveyor for deposit in said second sheet receiving area and to said first longitudinally extending conveyor for deposit in said first sheet receiving area.

10. A machine as set forth in claim 9 wherein said first plurality of magnets comprises the first two magnets nearest said infeed conveyor.

11. A machine as set forth in claim 9 wherein said conveyor additionally comprises a second plurality of spaced apart normally energized magnets.

12. In a machine for handling metal sheet materials, a longitudinally extending conveyor structure comprising a plurality of elongate roller supporting units in the form of elongate channel members spaced transversely of a center unit, each of said channel members having rollers mounted thereon in longitudinally spaced relation with the rollers on the outermost units at a higher elevation than the rollers on the units which are disposed inwardly thereof so as to form a sheet supporting bed which bows downwardly about a longitudinal line intermediate the outermost units so as to enable a sheet carried thereon to bow downwardly along a longitudinal line and magnets positioned in said bed inwardly of the outermost units so as to apply magnetic force to a sheet carried thereon and cause the sheet to bow downwardly along said longitudinal line so as to stiffen the sheet for better longitudinal movement.

13. A machine for handling metal sheets of material responsive to magnetic forces, said machine comprising an elongate upright frame structure arranged to provide longitudinally aligned and spaced first and second sheet receiving areas each adapted to accommodate a plurality of sheets in stacked relation, a first longitudinally extending conveyor means arranged to advance sheets received thereon in a longitudinal path for deposit in said first sheet receiving area, a second longitudinally extending conveyor means arranged to advance sheets received thereon in a longitudinal path for deposit in said second sheet receiving area, said longitudinally extending conveyors each comprising a series of rail-like skate roller supporting members arranged in side-by-side relation with alternate roller support members mounted for adjustment in the direction longitudinally of the machine, an infeed conveyor means having a sheet discharging end positioned to deliver sheets to said first longitudinally extending conveyor means, means for driving said infeed conveyor to advance sheets thereon, an elongate overhead sheet carrying magnetic conveyor arranged above said discharging end of said infeed conveyor and extending to a point above said second longitudinally extending conveyor, means for driving said overhead magnetic conveyor to advance sheets carried thereon in said longitudinal path and control means for controlling said overhead magnetic conveyor so as to enable sheets to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area.

14. A machine for handling metal sheets of material responsive to magnetic forces, said machine comprising an elongate upright frame structure arranged to provide longitudinally aligned and spaced first and second sheet receiving areas each adapted to accommodate a plurality of sheets in stacked relation, a first longitudinally extending conveyor means arranged to advance sheets received thereon in a longitudinal path for deposit in said first sheet receiving area, a second longitudinally extending conveyor means arranged to advance sheets received thereon in a longitudinal path for deposit in said second sheet receiving area, said longitudinally extending conveyor means each comprising a plurality of elongate roller supporting members arranged in side-by-side relation, rollers mounted on said supporting members in longitudinally spaced relation and forming a sheet supporting bed with the rollers on the outermost supporting members at a higher elevation than the rollers on the supporting members which are spaced inwardly thereof so as to impart a transverse curvature to the sheet supporting bed, and magnets mounted in said supporting bed so as to apply magnetic force to a sheet carried thereon and cause the sheet to bow downwardly along the center line and stiffen the sheet for better longitudinal movement, an infeed conveyor means having a sheet discharging end positioned to deliver sheets to said first longitudinally extending conveyor means, means for driving said infeed conveyor to advance sheets thereon, an elongate overhead sheet carrying magnetic conveyor arranged above said discharging end of said infeed conveyor and extending to a point above said second longitudinally extending conveyor, means for driving said overhead magnetic conveyor to advance sheets carried thereon in said longitudinal path and control means for controlling said overhead magnetic conveyor so as to enable sheets to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area.

15. A machine for handling metal sheets of material responsive to magnetic forces, said machine comprising an elongate upright frame structure arranged to provide longitudinally aligned and spaced first and second sheet receiving areas each adapted to accommodate a plurality of sheets in stacked relation, each of said sheet receiving areas having an associated back stop assembly, an end stop assembly and a side guide assembly for confining sheets delivered thereto and guiding them into a vertical pile formation, each of said sheet receiving areas comprising a lift assembly with a drive motor and a proximity detector located at an associated back stop assembly and coupled to an associated lift drive motor for lowering the sheet receiving areas when the top of the sheet piles reach a level approximate to the proximity detectors and a time delay relay coupled to an associated proximity switch to assure that said sheet receiving areas are lowered only due to the level of the sheet piles, a first longitudinally extending conveyor means arranged to advance sheets received thereon in a longitudinal path for deposit in said first sheet receiving area, a second longitudinally extending conveyor means arranged to advance sheets received thereon in a longitudinal path for deposit in said second sheet receiving area, an infeed conveyor means having a sheet discharging end positioned to deliver sheets to said first longitudinally extending conveyor means, means for driving said infeed conveyor to advance sheets thereon, an elongate overhead sheet carrying magnetic conveyor arranged above said discharging end of said infeed conveyor and extending to a point above said second, longitudinally extending conveyor, means for driving said overhead magnetic conveyor to advance sheets carried thereon in said longitudinal path and control means for controlling said overhead magnetic conveyor so as to enable sheets to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area.

16. A machine as set forth in claim 15 wherein said back stop assembly, said end stop assembly and said side guide assembly are adjustably positioned so as to enable sheets of different predetermined size to be handled in said piling areas.

17. A machine for handling metal sheets of material responsive to magnetic forces, said machine comprising an elongate upright frame structure arranged to provide longitudinally aligned and spaced first and second sheet receiving areas each adapted to accommodate a plurality of sheets in stacked relation, said sheet receiving areas each having an end stop member mounted adjacent the leading side of said area and a back stop member mounted adjacent the trailing side of said area, and means mounting said end stop and back stop members for adjustment longitudinally of the machine so as to adapt the machine for piling sheets of different lengths, a first longitudinally extending conveyor means arranged to advance sheets received thereon in a longitudinal path for deposit in said first sheet receiving area, a second longitudinally extending conveyor means arranged to advance sheets received thereon in a longitudinal path for deposit in said second sheet receiving area, said longitudinally extending conveyor means including a portion which is mounted for adjustment longitudinally of the machine and which is connected to the associated back stop member for simultaneous adjustment with said back stop member, an infeed conveyor means having a sheet discharging end positioned to deliver sheets to said first longitudinally extending conveyor means, means for driving said infeed conveyor to advance sheets thereon, an elongate overhead sheet carrying magnetic conveyor arranged above said discharging end of said infeed conveyor and extending to a point above said second longitudinally extending conveyor, means for driving said overhead magnetic conveyor to advance sheets carried thereon in said longitudinal path and control means for controlling said overhead magnetic conveyor so as to enable sheets to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area.

18. A machine for handling metal sheets of material responsive to magnetic forces, said machine comprising an elongate upright frame structure arranged to provide longitudinally aligned and spaced first and second sheet receiving areas each adapted to accommodate a plurality of sheets in stacked relation, a first longitudinally extending conveyor means arranged to advance sheets received thereon in a longitudinal path for deposit in said first sheet receiving area, a second longitudinally extending conveyor means arranged to advance sheets received thereon in a longitudinal path for deposit in said second sheet receiving area, an infeed conveyor means having a sheet discharging end positioned to deliver sheets to said first longitudinally extending conveyor means, means for driving said infeed conveyor to advance sheets thereon, an elongate overhead sheet carrying magnetic conveyor arranged above said discharging end of said infeed conveyor and extending to a point above said second longitudinally extending conveyor, means for driving said overhead magnetic conveyor to advance sheets carried thereon in said longitudinal path and means for controlling said overhead magnetic conveyor so as to enable sheets to be selectively delivered by the infeed conveyor to said first longitudinally extending conveyor for deposit in said first sheet receiving area, or to said overhead magnetic conveyor for advance to said second longitudinally extending conveyor for deposit in said second sheet receiving area, said magnetic conveyor comprising a first plurality of spaced apart manually deenergized magnets and a second plurality of spaced apart normally energized magnets, said control means comprising a proximity detector located at said infeed conveyor for detecting each sheet carried on said infeed conveyor, a counter coupled to said proximity detector for providing a control signal upon the detection of every other sheet and magnet control means coupled to said counter for controlling the energizing of said first plurality of magnets responsive to said control signal to enable alternate sheets to be advanced to said second longitudinally extending conveyor for deposit in said second sheet receiving area and to said first longitudinally extending conveyor for deposit in said first sheet receiving area, and a magnet selector coupled to said second plurality of magnets for rendering selected ones of said second plurality of magnets normally deenergized to thereby bring said selected magnets under the control of said magnet control means.

* * * * *